United States Patent [19]

Gantz et al.

[11] Patent Number: 4,822,232

[45] Date of Patent: Apr. 18, 1989

[54] UPSTACKING DEVICE FOR A SHELL CONVERSION PRESS

[75] Inventors: Vernon C. Gantz, Dayton; Robert H. Elliott, Vandalia, both of Ohio

[73] Assignee: Dayton Reliable Tool & Mfg. Co., Dayton, Ohio

[21] Appl. No.: 66,590

[22] Filed: Jun. 27, 1987

[51] Int. Cl.[4] ..... B65G 57/30

[52] U.S. Cl. ..... 414/795.3; 198/803.15; 414/790.9

[58] Field of Search ..... 198/803.15; 414/96, 414/51

[56] References Cited

U.S. PATENT DOCUMENTS

| | | | |
|---|---|---|---|
| 3,360,100 | 12/1967 | Seragnoli | 414/96 X |
| 4,221,518 | 9/1980 | Carazza | 414/96 X |
| 4,390,098 | 6/1983 | Wilgus et al. | 414/96 X |
| 4,640,116 | 2/1987 | Brown | 413/8 X |

*Primary Examiner*—Robert J. Spar
*Assistant Examiner*—Janice Krizek
*Attorney, Agent, or Firm*—Biebel, French & Nauman

[57] ABSTRACT

An upstacking device is shown for use with generally flat metal can ends. The device is used with an endless conveyor such as a transport belt having openings therein, with each opening receiving a shell for locating the shell on the belt. The belt is intermittently advanced. The upstacking device includes a drive input coupled to a main drive for producing reciprocating rotational motion. A drive shaft is rotationally mounted to the frame. A stacking arm is fixedly connected to the drive shaft so that reciprocating rotation of the shaft produces rising and falling motion of the distal end of the arm. Stack pistons are pivotally connected to the stacking arm and have can end engaging surfaces. The drive shaft, stacking arm and pistons are positioned such that (a) whenever the stacking arm is in a lowered position, the shell-engaging surfaces are positioned below the belt, and (b) the pistons are aligned with the openings for movement therethrough. A clutch selectively engages the drive input with the drive shaft and alternately engages the drive shaft with the frame.

14 Claims, 7 Drawing Sheets

UPSTACKING DEVICE FOR A SHELL CONVERSION PRESS

BACKGROUND OF THE INVENTION

The present invention relates generally to press apparatus for forming ends for metal cans, and more particularly, to an upstacking device used to remove ends from the press apparatus and place them into a stacked condition for packaging. Such apparatus is commonly used in converting previously formed shells into ends for self-opening cans and the like.

The production of metal can ends comprises a series of different operations, with a typical sequence described in U.S. Pat. No. 3,366,086. This patent discloses steps for initially creating the shell, and also describes scoring the opening in the shell, creating a pull tab, and making an integral rivet connection between the tab and the end. These latter three steps are often referred to collectively as conversion of the shells.

Certain presses, know as conversion presses, include tooling and related apparatus specifically adapted for carrying out this latter portion of the can end manufacturing process. One example of such a press is shown in U.S. Pat. No. 4,640,116. A typical conversion press includes a two-lane conveyor belt extending through the press and through in-line conversion tooling. Cooperating with the conveyor are downstacking and upstacking mechanisms located near but spaced from the slide. The downstacking mechanism provides unconverted shells which are received in circular apertures in the conveyor belt. The belt is moved stepwise through the press in synchronism with the opening and closing of the tooling. As a result of the press operation, an opening is scored in each shell, and a tab is formed and attached. After the converted ends move beyond the slide, the upstacking mechanism pushes the completed ends from the belt into a stack, from which the ends may be removed for further processing.

Occasionally, a defective end may be produced by the conversion press tooling. In such a case, it is necessary to temporarily halt the operation of the upstacker in order to prevent the defective end or ends from being placed into the stack of completed ends. However, such defective ends usually occur in isolated instances. Discontinuing of the upstacking operation is thus usually necessary only for one or several strokes of the press.

Accordingly, it is not efficient to stop the entire press to remove the defective ends. Rather, a better approach is to temporarily disable the upstacker mechanism so that the defective ends will continue along the conveyor belt to a later discharge position. After the defective ends have passed the upstacking mechanism, the mechanism can be re-engaged to continue the upstacking operation. One such engagement and disengagement means is disclosed in the above referenced U.S. Pat. No. 4,640,116.

SUMMARY OF THE INVENTION

The present invention provides an upstacking device which incorporates an improved engagement and disengagement means to permit defective ends to pass beyond the upstacking device. The upstacking device is used with an end transport means which includes an endless transport belt having a plurality of openings therein. Each opening receives an end for locating the end on the belt. Drive means intermittently advances the belt.

The upstacking device includes input means coupled to the drive means for producing reciprocating rotational motion. A support frame is included, and a drive shaft is mounted for rotation to the frame along a horizontal axis. A stacking arm is fixedly connected to the drive shaft and includes a distal end, whereby reciprocating rotation of the shaft produces rising and falling motion of the distal end between raised and lowered positions.

A stack piston means is pivotally connected to the distal end of the stacking arm and has an end engaging surface. The drive shaft, stacking arm and piston means are mounted to the supporting frame such that (a) whenever the stacking arm is in the lowered position, the end engaging surface is positioned below the belt, and (b) the piston means is aligned with the openings for movement therethrough. A clutch means is provided for selectively engaging the input means with the drive shaft and alternatively engaging the drive shaft with the frame.

The stack piston means may include a stack piston rigidly connected to a piston support block, with the piston support block being pivotally connected to the stacking arm. Piston guide means confines the piston to reciprocating movement in a vertical direction.

The input means may be positioned on the drive shaft for rotational motion about the drive shaft along the horizontal axis. The input mans can include a cam connected to the drive means for rotation, with cam follower means coupled to the cam for following the cam in a reciprocating motion. An input arm is connected for pivotal motion to the cam follower means and to the drive shaft for reciprocating rotational motion thereon.

The clutch means may include a clutch block slidably mounted to the drive shaft but rotationally fixed thereon. Means is provided for selectably sliding the clutch block along the drive shaft from a position adjacent the input arm to a second position remote from the arm. Engagement means engages the clutch block with the input arm when in the first position whereby the input arm and the clutch block are rotationally locked.

In such a case, the clutch block and input arm together may define first and second surfaces positioned adjacent each other whenever said clutch block is in the first position. The engagement means includes at least one ridge defined on the first surface and an equal number of corresponding recesses defined on the second surface. Also, the support frame may include an engagement portion located adjacent the drive shaft such that the engagement portion is disposed adjacent the clutch block when in the second position. The clutch means then includes second engagement means for engaging the clutch block with the engagement portion when in the second position, whereby the support frame and clutch block are rotationally locked.

The means for sliding the clutch block may include gripping means for gripping the clutch block, and actuating means for causing lateral movement of the gripping means in a direction parallel to the shaft. The clutch block includes a circumferential recess defined around the block, with the gripping means including a yoke member having a pair of legs engaged with the recess and a rod pivotally connected to the support frame for pivotal movement in a plane parallel to the shaft, and the actuating means includes an actuator connected to the rod and linear drive means for extending and retracting of the actuator.

As an alternative embodiment, the input means may be fixedly connected to the drive shaft, with the stacking arm positioned on the drive shaft for rotational motion thereabout. The clutch means is then constructed to selectively alternatively engage and disengage the stacking arm and the drive shaft.

Accordingly, it is an object of the present invention to provide an upstacking device for placing relatively flat objects transported on a belt into a vertical stack; to provide such a device which places such objects into a stack by moving each object upwardly to the bottom of the stack; to provide such a device which is particularly adapted for use with metal can ends; to provide such a device which has the capability of being selectively disengaged to permit certain ends to bypass the stacking operation; to provide such a device which is capable of stacking operation at typical press speeds; and to provide such a device which is capable of actuation and deactuation between succesive ends at typical press speeds without disrupting press operations.

Other objects and advantages of the invention will be apparent from the following description, the accompanying drawings and the appended claims.

DETAILED DESCRIPTION OF THE PREFERRED EMBODIMENT

Figure 2:
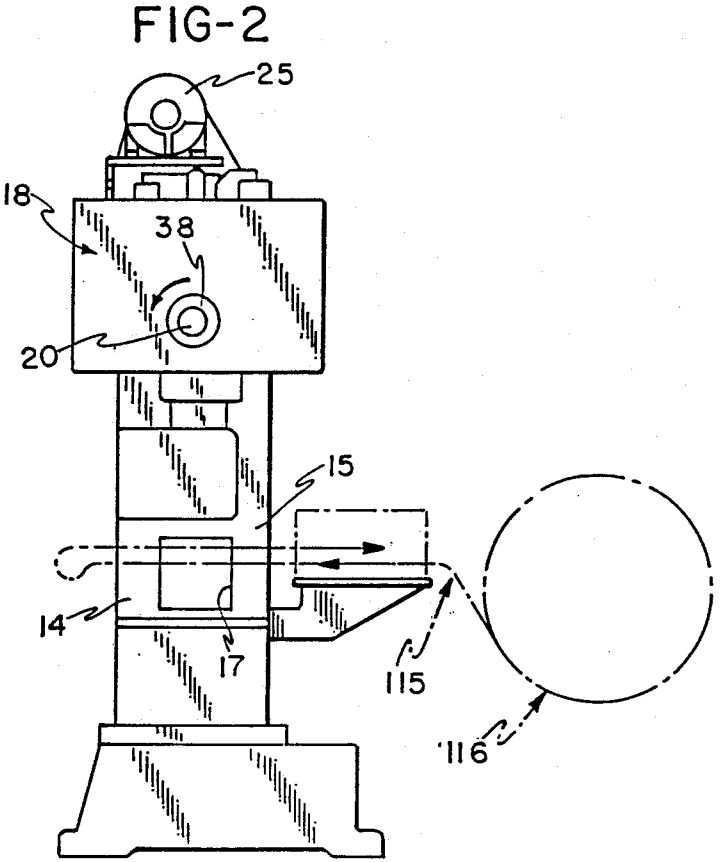
FIGS. 1 and 2 are front and side overall views of a press with which the present invention may be used.
Figure 1:
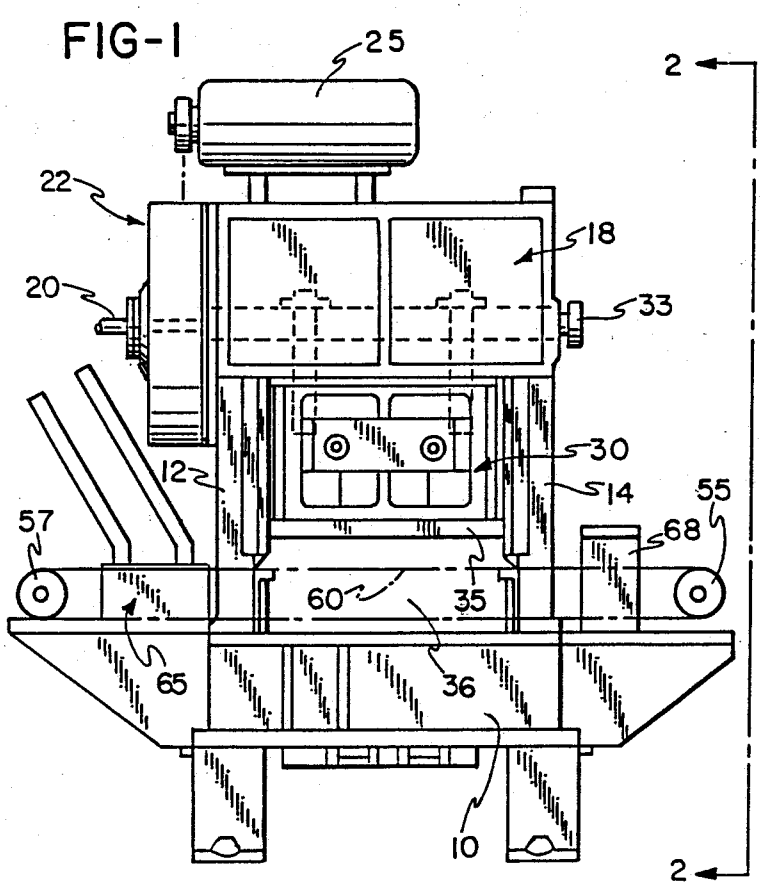
Figure 3:
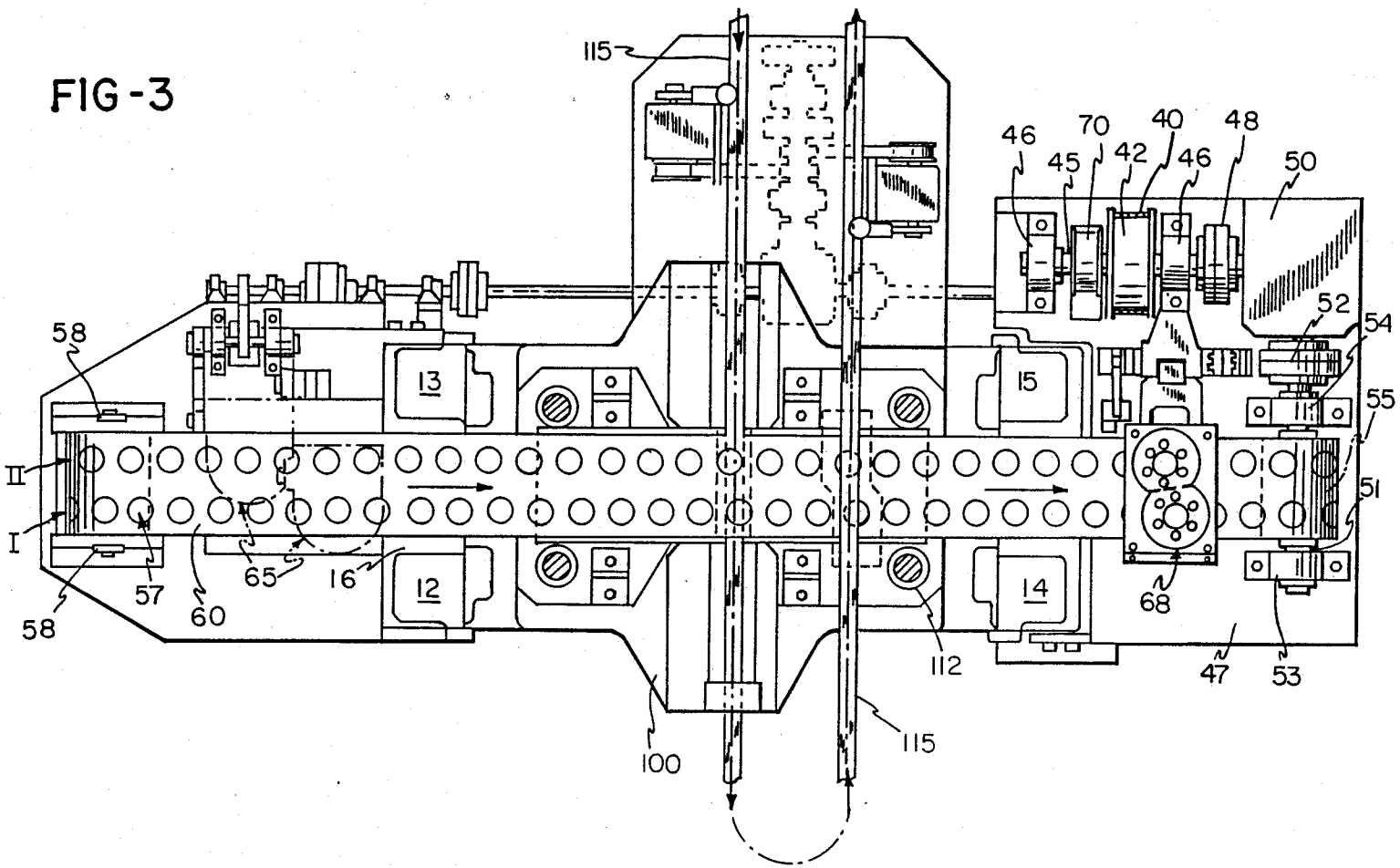
FIG. 3 is a plan view of the conveyor belt and related parts of the press shown in FIGS. 1 and 2.

Referring generally to FIGS. 1, 2 and 3, the overall configuration of a press with which the present invention may be used is shown. Generally, the press includes progressive tooling for working upon preformed shells to score an opening, to form completed tabs from a strip of material, and to attach the tabs to complete the manufacture or conversion of the shells into ends for cans and similar containers.

Thus, it should be understood that as used herein, the term "shell" refers to an object formed to a configuration which permits attachment as a closure to a metal can. Once the shell has had an opening means formed therein, the shell is refered to as an "end." The stacking mechanism described herein, while generally intended for use in stacking converted ends, may be used equally in stacking shells as the need may be.

For purposes of this description the press illustrated in FIGS. 1, 2 and 3 is typical of a single-acting press, and includes a bed 10, side frames including uprights 12, 13, 14 and 15 surrounding side openings 16 and 17, and a crown 18 supported on the side frames. The crank 20 is rotatably supported in the crown, has secured to it a flywheel 22, and is belt-driven by a drive motor 25 supported on top of the crown structure. The crank is connected to the slide 30 by a pair of connecting rods (not shown), and in conventional fashion cooperative upper and lower tooling sets indicated by the general reference numerals 35 and 36, are mounted on the slide and on the bed respectively. At the opposite side of the press from the flywheel, the crank 20 is fitted with a power take-off pulley 38.

Figure 4:
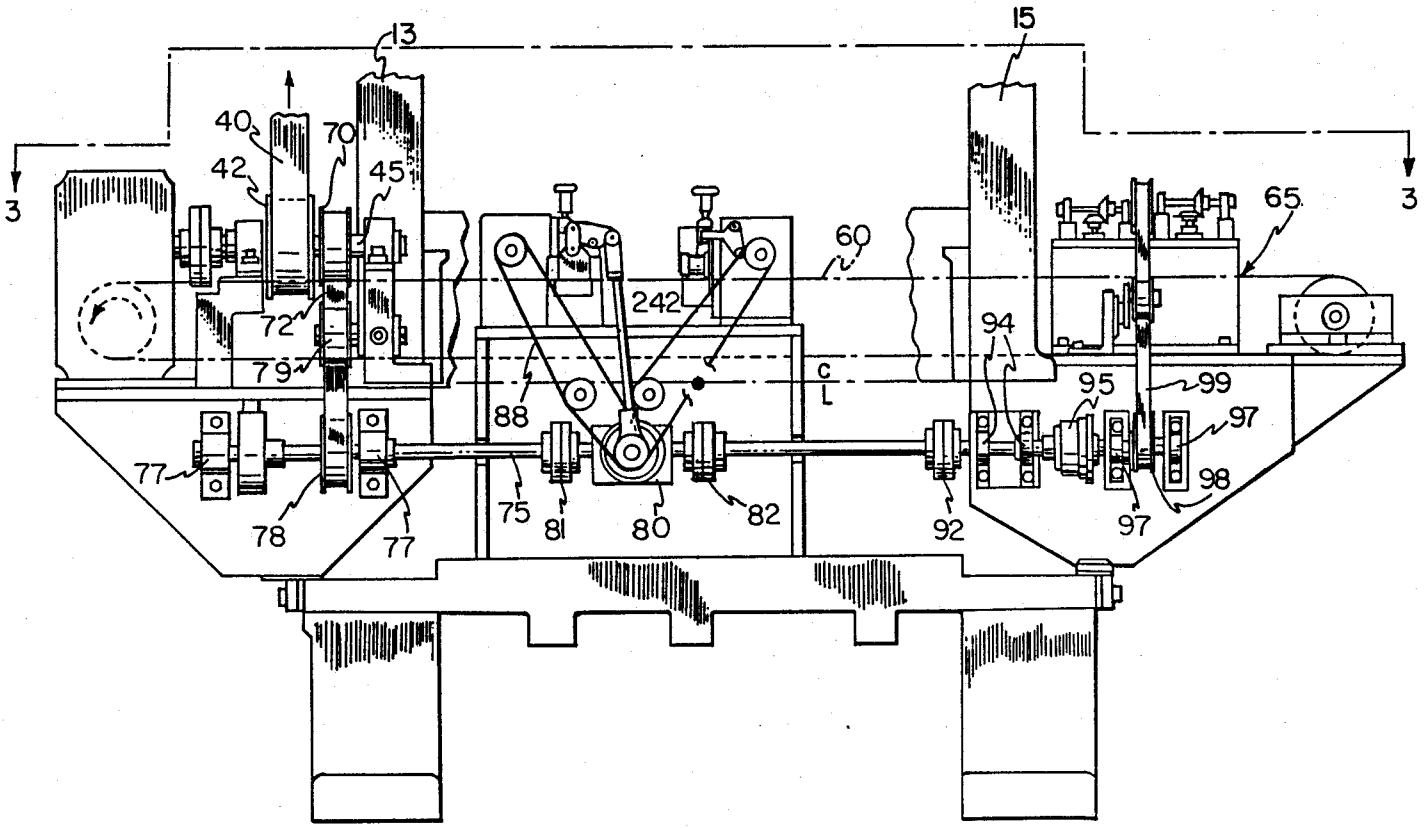
FIG. 4 is a view of the lower rear portion of the press, taken generally along line 4—4 in FIG. 3, showing details of the drive means for the conveyor belt, tab strip material, downstacking and upstacking devices.

Referring to FIGS. 3 and 4, a belt 40 transfers power from the crank pulley 38 to a pulley 42 connected to drive a shaft 45 which is mounted in suitable bearings 46 supported outboard from the uprights or posts 14 and 15 which are part of the right hand side frame of the press (as viewed from the front). Shaft 45 is connected via a coupling 48 to a right angle intermittent drive unit 50, of conventional construction, which in turn is connected through an output coupling 52 to a shaft 51 supported in bearings 53 and 54 and carrying a drive drum 55 which is rotated in timed intermittent fashion, synchronized with the rotation of the crank 20, and therefore with the motion of the press slide 30. At the other (or left) side of the press, outboard of the side frame and posts 12 and 13, an idler drum 57 is supported in suitable bearings 58. Extending between the drums 55 and 57 is a conveyor means in the form of a belt 60.

Belt 60 is of the endless type, made preferably of material such as thin stainless steel, and is provided with two rows or paths of regularly spaced carrier openings 62. These openings are of a diameter such that the lip of a shell overlaps the edge of the openings, and thus shells deposited on the belt cover each of the openings and are carried by the belt through the tooling, in intermittent or stepwise fashion, synchronized to the operating strokes of the press. Shells to be converted are loaded onto belt 60 at the loading station indicated by general reference numeral 65 in FIG. 3, and the converted finished ends are unloaded from belt 60 at the unloading station indicated by the general reference numeral 68. The loading and unloading mechanisms, the latter described later in detail, are also referred to in the art, as a downstacker mechanism and an upstacker mechanism. This terminology refers to the manner in which these mechanisms remove single shells from the bottom of a supply stack and place a single shell onto an opening in the belt, and at the discharge location, remove the finished ends and pass them upwardly into a stack.

Referring now specifically to FIG. 4, the power take-off shaft 45 also is fitted with a pulley 70 that is connected via belt 72 to a pulley 78 mounted on a further shaft 75 extending across the rear of the press bed. Shaft 75 is supported in the vicinity of pulley 78 in bearings 77 and is driven by belt 72. The pulley 79 immediately above pulley 78 is an adjustable idler for the purpose of keeping proper tension in belt 72. Shaft 75 extends through a coupling 81 to the input of a right angle gear drive unit 80, and through that unit and a further coupling 82 to shaft 75.

Shaft 75 is connected by further couplings 92 to extend to the right as seen in FIG. 4. Shaft 75 is supported in suitable bearings 94, and in turn drives a final section of shaft 75 through an overload clutch 95. This final shaft section is supported in bearings 97 below and rearward of the loading station 65, and a pulley 98 and belt 99 provide power to that station.

Referring again to FIG. 3, upper and lower tooling sets which operate upon the shells and tab material are located within the press between side openings 16 and 17. Such tooling is not shown herein, but may be conventional tooling. Further details regarding this tooling can be found in U.S. Pat. No. 4,640,116, Column 5, line 10 through Column 7, line 23, which is hereby incorporated by reference. For purposes of this description, it is sufficient to note that the lower tooling set of the tooling is mounted onto subplate 100. The tooling is arranged in a plurality of stations along the two lanes of conveyor 60. Thus, each shell is converted in a stepwise fashion. Conveyor 60 is incrementally advanced between strokes of the press, positioning the shell at each successive station.

Similarly, appropriate tab-forming tooling is also fitted onto subplate 100, arranged to extend transversely of the end conversion tooling, in a direction generally front to back of the press. Tab strip material 115 from a roll 116 (FIG. 2) is fed along the tab-forming path. The completed tabs remain attached to the material strip as it is looped back to the transfer/stake station. There, the tabs are removed from the strip, attached to the ends, and the remainder of the strip proceeds to scrap collection. Again, details of the tab-forming tooling are not shown since they will vary with the type of end being made, and are not necessary for an understanding of the invention. However, further details regarding this operation may be seen by reference to the above-noted U.S. Pat. No. 4,640,116.

Along the path of conveyor 60, beyond frame opening 17, the upstacker mechanisms 68 are mounted above and below conveyor belt 60. Further details with regard to this mechanism can be seen by reference to FIG. 5.

Connected to shaft 75 is a cam 120 having a cam slot 122 defined therein. Slot 122 is circular for at least one-half of the rotation of cam 120, but extends inwardly toward shaft 75 over the remaining portion of its rotation. A cam follower 124 is positioned within slot 122, and is mounted to a follower arm 126 pivotally connected at 128 to an apron 130 securely fixed to the press frame. Follower arm 126 is unconnected at its opposite end, so that rotation of shaft 75 results in periodic fall and rise of arm 126 as a result of follower 124 moving within cam slot 122.

Figure 6:
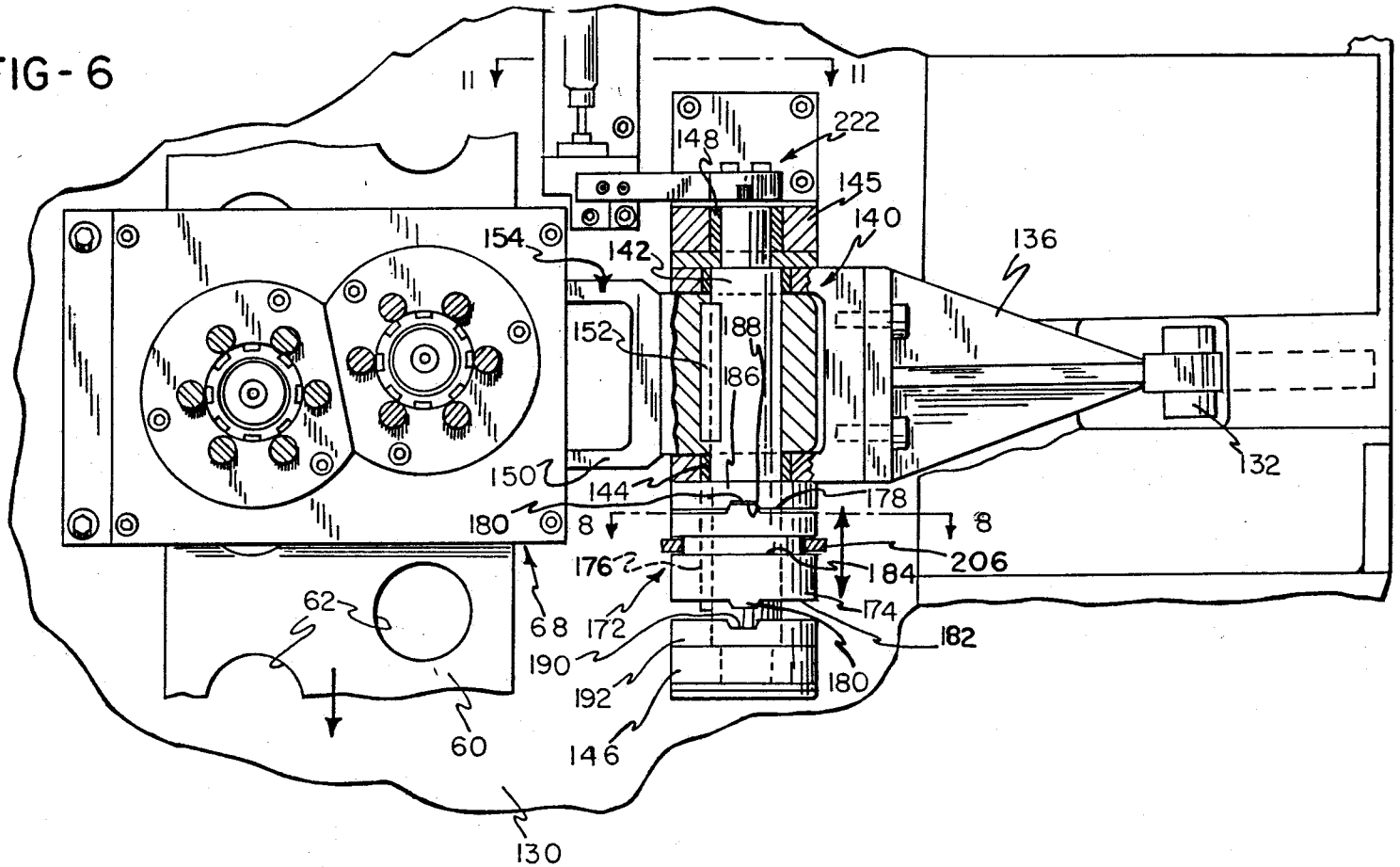
FIG. 6 is plan view of the upstacking device shown in FIG. 5 with portions broken away.

Follower arm 126 is pivotally connected to a link 132, which together extend through frame 130, with link 132 being pivotally connected at 134 to a driving arm 136. Referring now to FIG. 6, arm 136 defines a clevis portion 140 which is mounted for rotation on a shaft 142. Appropriate bearings 144 are positioned between arm 13 and shaft 142 to ensure that arm 136 can freely pivot about the shaft.

It can be seen from the foregoing description that as shaft 75 rotates, cam follower 124 within cam slot 122 causes link 132 to move reciprocably downwardly and upwardly. This in turn moves arm 136, which rotates in reciprocating fashion through a small angle of arc on shaft 142.

Shaft 142 is in turn supported at its ends by retaining blocks 145 and 146, each secured to the press frame 130. Within each retaining block, referring specifically to retaining block 145, shaft 142 is positioned within an appropriate bushing 148 which permits free rotation of shaft 142 within the retaining blocks 145 and 146. Thus, while arm 136 is rotatable on shaft 142, shaft 142 is itself rotatable independent of arm 136.

Extending from shaft 142 and positioned between the clevis of arm 136 is a second arm 150. Arm 150 is solidly secured to shaft 142, being fixed against rotation on the shaft by an appropriate key 152. Arm 150 also includes a clevis portion 154 which extends beneath upstacker station 68.

Figure 7:
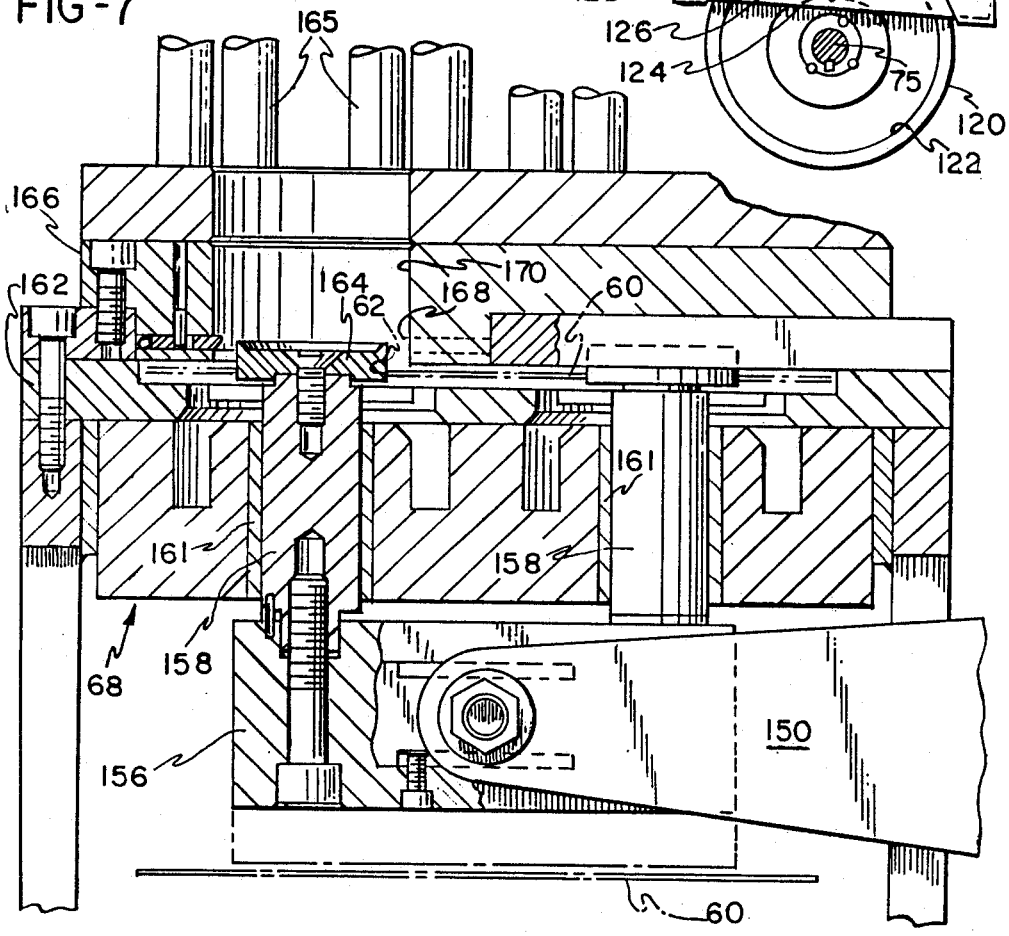
FIG. 7 is an enlarged side view of a portion of the device showing the stacking pistons with portions broken away.

Referring now to FIG. 7, arm 150 extends beneath upstacker station 68, where it is pivotally connected to a lifting block 156. Block 156 is in turn rigidly connected to a pair of pistons 158 which are slidably located within openings in a guide block 160. Appropriate bushings 161 are included within the openings to reduce friction. Guide block 160 is held in position by a support platform 162 which is in turn rigidly connected to the press frame 130.

Guide block 160 is positioned immediately beneath the upper path of conveyor path 60. Further, it being recalled that belt 60 includes openings 62 within which shells are received, pistons 158 are positioned to align with openings 62 during the non-moving portion of the operation of belt 60. Thus, as belt 60 is incrementally advanced, it will come to rest between each increment with an opening 62 located directly over each piston 158. Subsequent advance of belt 60 will result in the next successive opening 62 along the appropriate lane of conveyor 60 being located over piston 158.

Each piston is provided with a pusher member 164 which conforms with the bottom surface of a can end. Because pistons 158 are vertically slidable within guide block 160, pistons 158 can be raised, in a manner to b described below, such that pusher members 164 contact any ends positioned within the openings 62 located immediately over pistons 158. Upward movement of pistons 158 will cause pusher members 164 to lift any ends upwardly. (It should be noted that pistons 158 are shown in their uppermost positions in FIG. 5.)

An upper end guide block 166 is secured to structure 162 for receiving any ends lifted by pistons 158. Spring loaded pawls 168 extend slightly into openings 170 formed in guide block 166. Pawls 168 include beveled leading edges, so that ends may be moved past pawls 168, but will be retained within openings 170 when pistons 158 and pusher members 164 are retracted. Upwardly extending retaining rods 165 hold the ends in an upwardly extending stack as further ends are lifted by pistons 158.

Returning to FIG. 6, a clutch mechanism 172 is provided to enable arm 136 to be coupled to arm 150. Clutch mechanism 172 includes a clutch block 174 which is slidably positioned on shaft 142. However, while slidable along the shaft, clutch block 174 is rotationally secured to shaft 142 by a key 176 fitted into both clutch block 174 and shaft 142.

Figure 8:
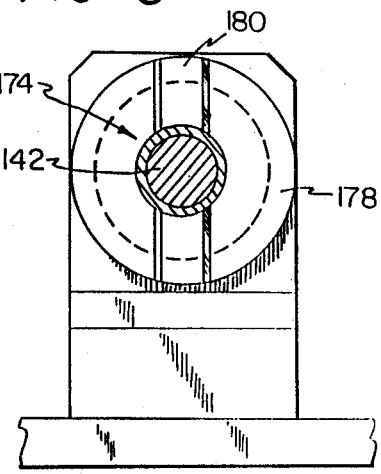
FIG. 8 is an end view of the clutch block, taken generally along line 8—8 in FIG. 6.

As seen in FIG. 8, clutch block 174 includes on its face 178 ridges 180 which extend outwardly from face 178. Each ridge 180 is preferably beveled to be trapezoidal in cross-section, but can be of other shapes as will be recognized from the following description. As seen from FIG. 6, clutch block 174 also includes an opposite face 182 including ridges 180 arranged in a manner substantially identical to that shown in FIG. 8.

Clutch block 174 is also provided with a circumferential recess 184 extending completely around the central portion of clutch block 174.

Secured to the leg of clevis portion 140 of arm 136 nearest clutch block 174 is an engagement plate 186. Engagement plate 186 has formed in its surface a plurality of recesses 188 defined to correspond to ridges 180 on face 182 of clutch block 174. As seen in FIG. 6, ridges 180 on face 182 can be engaged with recesses 188 in engagement plate 186. As a result, clutch block 174 may be rotationally locked with arm 136.

When in the position shown in FIG. 6, clutch block 174 serves to interconnect arm 136 with arm 150. To better understand why this is so, consideration will be briefly given to the operation of the portions of the device described thus far.

Figure 5:
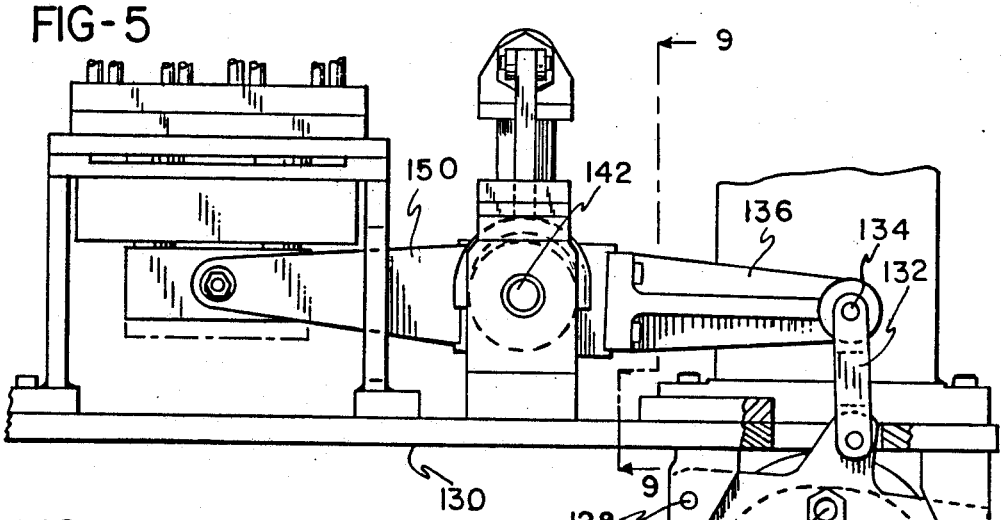
FIG. 5 is a side view of the upstacking device in accordance with the present invention.

Reviewing briefly FIG. 5, rotation of drive shaft 75 causes cam follower 124 positioned within cam slot 122 to be drawn downwardly and moved back upwardly once per revolution. However, between such movement, a substantial dwell period will be provided, as a result of the circular portion of slot 122 occupying greater than half the arc of cam 120. This periodic downward movement will be transferred through link 132 to arm 136, which will pivot downwardly around the axis defined by shaft 142.

Referring now to FIG. 6, because arm 136 is connected to clutch block 174 through the engagement of recesses 188 and ridges 180, the reciprocating motion of arm 136 will cause reciprocating rotational motion of clutch block 174. Since block 174 is keyed to shaft 142, this will in turn cause similar reciprocating rotational motion of the shaft. Moreover, since shaft 142 is keyed to arm 150, the rotating motion of shaft 142 ill cause reciprocating pivotal motion of arm 150.

As seen in FIG. 7, the reciprocating motion of arm 150 will cause reciprocating vertical motion of pistons 158. Thus, the pistons 158 will be periodically raised to push completed ends upwardly into end-receiving openings 170. Pistons 158 will then be retracted. Since a dwell period is provided by cam 120, pistons 158 will remain stationary for a period of time sufficient to advance belt 60 to align the next pair of openings 62 with pistons 158.

It will be recalled that one function of the upstacking device is to cease temporarily any upstacking operation so that defective ends may be permitted to continue along conveyor belt 60 to an appropriate discharge location. It will further be recalled that clutch block 174, while keyed to shaft 142, is slidably movable thereon. This slidable motion serves as the basis for enabling the upstacker device to be selectively and intermittently disabled.

Referring specifically to FIG. 6, it can be seen that sliding movement of clutch block 174 along shaft 142 from the position shown in FIG. 6 will cause ridges 180 on face 178 of block 174 to disengage from recesses 188 formed in engagement plate 186. Once this has occurred, arm 136 is no longer connected through clutch block 174 to shaft 142. Consequently, pivotal motion of arm 136 now merely results in rotation of arm 136 on bearings 144 about shaft 142.

Further sliding movement of block 174 causes ridges 180 formed in face 182 of clutch block 174 to engage with grooves 190 formed in an engagement plate 192 fixed to retaining block 146. Retaining block 146 is, of course, secured to the press frame 130. Thus, when clutch block 174 is engaged with engagement plate 190, it is locked to the press frame. In addition, since clutch block 174 is still keyed to shaft 142, shaft 142 and arm 150 are also locked to the frame. Thus, upon movement of clutch block 174, arm 150 and the upstacking mechanism is not merely disengaged from arm 136, but is in fact locked against movement. This is important, since belt 60 and other press apparatus continues to move. Any interference by the upstacking mechanism with these moving parts could seriously damage the upstacking mechanism or other press components.

Of course, it will be recognized that the upstacking mechanism will function in the absence of locking of the mechanism with the press frame. In such a case, clutch block 174 is simply moved sufficiently to disengage block 174 from arm 136. However, while this will produce a functioning device, inclusion of the locking capability when the mechanism is deactivated is preferred.

Figure 10:
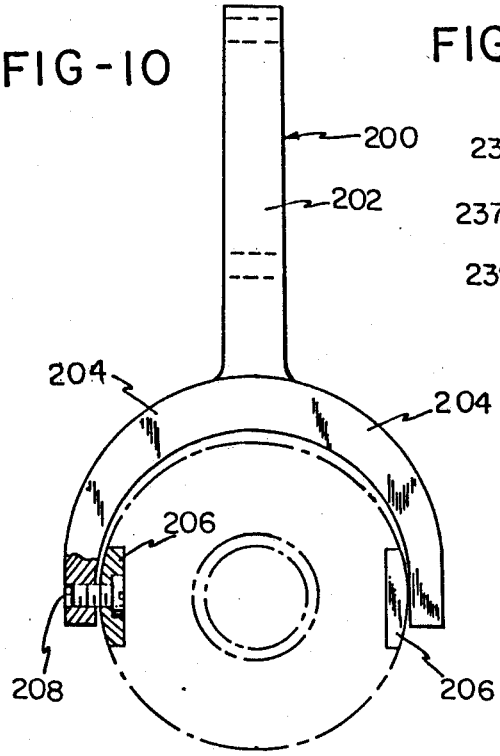
FIG. 10 is a view of the yoke for actuating the clutch block, taken generally along line 10—10 of FIG. 9.
Figure 9:
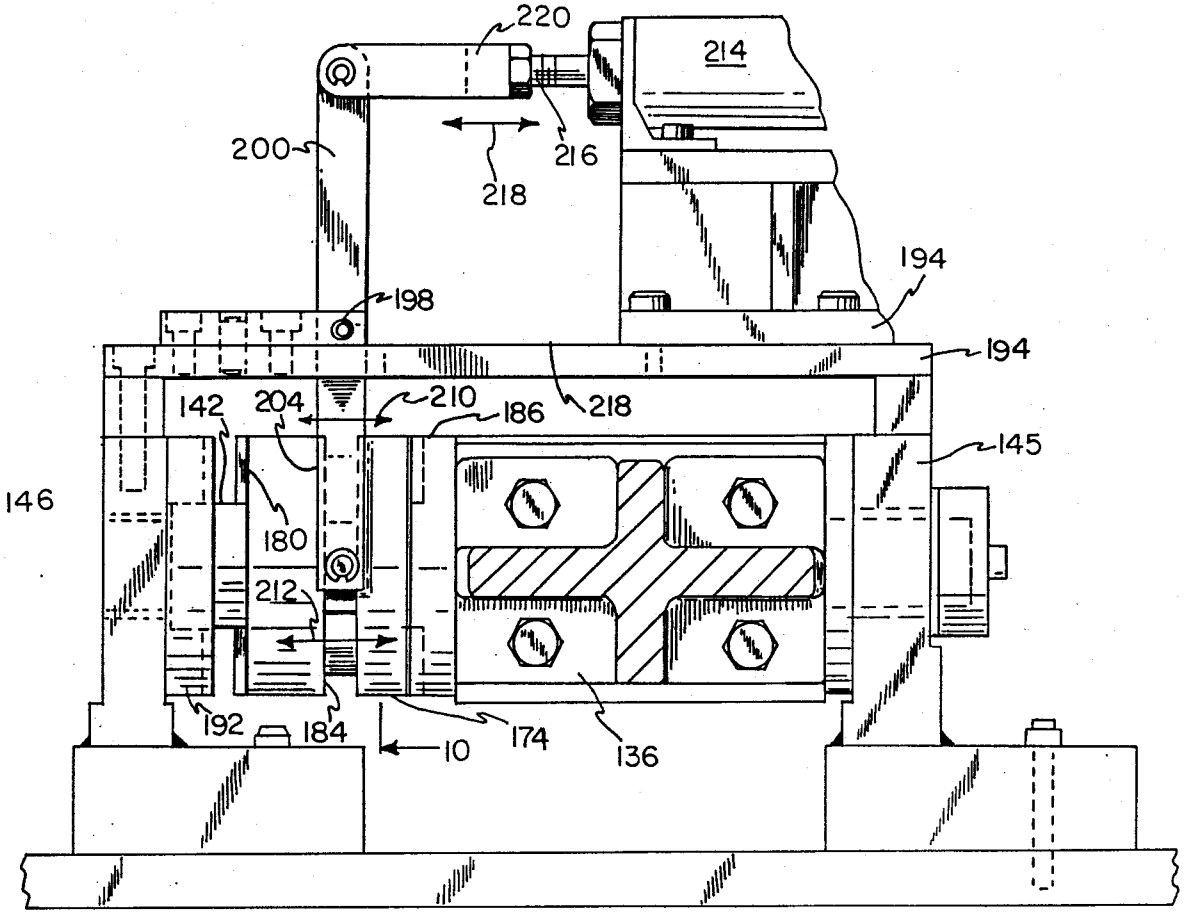
FIG. 9 is a view of the device taken generally along line 9—9 in FIG. 5.

The means by which clutch block 174 can be laterally shifted along shaft 142 can be seen by reference to FIG. 9. Located above shaft 142 and clutch block 174, mounted to retaining blocks 145 and 146, is a support plate 194. Secured to plate 194 is a support member 196 defining a slot at one end, having connected across the slot a pivot shaft 198. Suspended from shaft 198 and freely pivotal thereon is a yoke 200, which can be seen in greater detail by reference to FIG. 10. Yoke 200 includes a primary rod 202, which is intermediately supported by pivot shaft 198. At the lower end of rod 202, the yoke divides into a pair of yoke legs 204, which are positioned around clutch block 174. As seen also by referring back to FIG. 9, yoke legs 204 are positioned along clutch block 174 at recess 184. A pair of shoes 206, preferably formed from hardened tool steel, are pivotally connected by mounting means 208 to the lower, inner ends of yoke legs 204. Shoes 206 fit within recess 174, holding yoke 200 in relative position with respect to clutch block 174.

Referring back to FIG. 9, yoke 200 is pivotal about pivot shaft 198 in the directions generally indicated by arrow 210. Recalling that clutch block 174 is slidably mounted to shaft 142, it can be seen that pivotal movement of yoke 200, as a result of shoes 206 positioned within recess 184, causes clutch block 174 to move laterally along shaft 142 in a direction generally indicated by arrow 212. It will thus be appreciated that, referring back to FIG. 10, the inner curvature of yoke legs 204 must necessarily be broader than the greatest diameter of clutch block 174 since, during pivotal movement of yoke 200, yoke legs 204 must clear clutch block 174.

The means by which yoke 200 is pivoted to cause lateral sliding motion of clutch block 174 can be seen by reference back to FIG. 9. An air cylinder 214 drives an actuator 216 outwardly and inwardly from cylinder 214 in the directions shown generally by arrow 218. Actuator 216 is connected to a clevis means 220 which is pivotally attached to rod 202 of yoke 200. Thus, retraction of actuator 216 causes yoke 200 to move clutch block 174 in a leftward direction as seen in FIG. 9, disengaging the upstacking device by engaging clutch block 174 with engagement plate 192. Similarly, extension of actuator 216 by cylinder 214 causes yoke 200 to move clutch block 174 in a rightward direction as seen in FIG. 9, thereby moving clutch block 174 back into engagement with plate 186, reconnecting the upstacking mechanism for operation. One example of an appropriate air cylinder 214 is a Bimba air cylinder model No. BF-171-D.

It should also be noted from FIG. 9 that the total length of clutch block 174, as measured from the outermost portions of ridges 180 on both end faces of block 174 is less than the distance between the end surfaces of engagement plates 186 and 192. This is important in the event some equipment malfunction, or loss of electrical control power or compressed air causes clutch block 174 to stop at a position between engagement plates 186 and 192, wherein clutch block 174 will not fully engage one of plates 186 or 192. In such a case, while clutch block 174 may not be fully engaged, it also cannot partially engage both plates 186 and 196. If such simultaneous engagement were to occur, the press drive could become locked to the press frame, which could possibly cause serious damage to the apparatus or to the press.

In normal operation, shells properly converted into ends move along the conveyor belt to the upstacking mechanism, where they are lifted by the mechanism. Thus, clutch block 174 is normally engaged with engagement plate 186 on arm 136. This means that air cylinder 214 is normally energized to retract actuator 216 to move clutch block 174 to the furthest right position as seen in FIG. 9. Appropriate detectors (not shown) are located along the conveyor belt path to determine in a known manner when a defectively converted end has been produced. The detectors are connected into the press control system. Input from the detectors indicating the presence of a defective end is used to energize air cylinder 214 to extend actuator 216 outwardly, thereby moving clutch block 174 away from arm 136 and disengaging the upstacking mechanism.

In the preferred embodiment of the invention, then, acceptable finished ends are thrust up into the stacks, while detected unacceptable ends are carried to the end of the conveyor path and discharged over drum 55 (FIG. 3). This arrangement can readily be reversed, however, merely by having the fault detectors (not shown) actuate cylinder 214 in the opposite fashion. In such a case, only rejected ends will be raised into the stacks, and acceptable ends can discharge over drum 55 into any suitable collection device.

It should be recognized that engagement and disengagement of the upstacking mechanism can occur only during such time as the mechanism is stationary. Otherwise, the various engagement surfaces on the clutch block and engagement plates may be misaligned or may be in motion. In either case, damage to the apparatus could occur. Moreover, engagement and disengagement should occur only when pistons 158 and pusher members 164 (FIG. 5) are in their lowermost position. Otherwise, the synchronization necessary to coordinate belt movement with the upstacking operation could be adversely affected, also potentially damaging the apparatus. In this regard, it will be recalled that cam 120, which provides the reciprocating input to the upstacking mechanism, includes a significant dwell portion in the configuration of cam slot 122. This dwell period covers, for example, 210° of press crank rotation, which can provide a sufficient interval of non-movement of the device to permit engagement or disengagement of the clutch block.

Actuation of air cylinder 214 during this dwell period can be easily accomplished, since it is known to provide control for a press device similar to that disclosed herein through a rotary position switch coupled to the press drive. In such a control system, actuation of various press equipment is caused as a function of the press crank reaching a specified rotational position Thus, the actuation of air cylinder 214 can be programmed to occur at a rotational position of the crank which falls within the dwell period defined by cam slot 122 on cam 120.

As seen in FIG. 7, support block 156 is located directly over the lower path of belt 60. When arm 150 (FIG. 5) supporting block 156 is connected through clutch block 174 to arm 136 and the press drive, block 156 is held within the upper and lower limits of its stroke, thereby avoiding any contact with the lower path of belt 60. However, once arm 150 has become disengaged from the press drive, arm 150 is no longer counterbalanced and support block 156 is free to drop onto belt 60.

Figure 11:
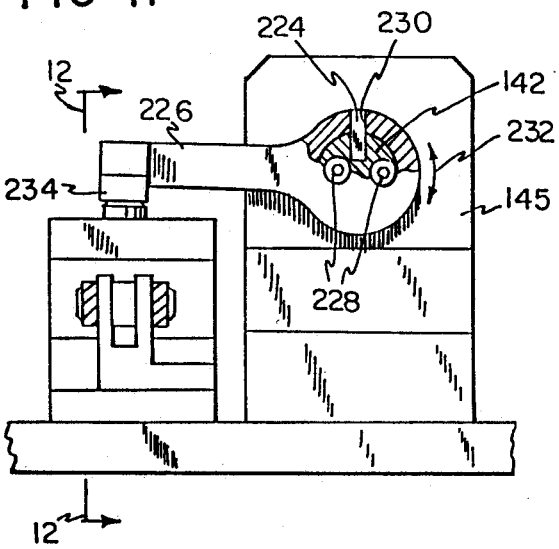
FIG. 11 is an end view of the stop mechanism for the device, taken generally along line 11—11 of FIG. 6.

Accordingly, referring now to FIG. 6, a stop mechanism 222 is mounted at one end of shaft 142 to support block 156 and to prevent any undesired contact of the upstacking mechanism with belt 60. Stop mechanism 222 is shown in detail in FIG. 11, where the end of shaft 142 can be seen supported in retaining block 145. Formed diametrically across the end of shaft 142 is a key 224. An arm 226 is secured by screws 228 to the end of shaft 142, arm 226 having a keyway 230 formed therein into which key 224 may be positioned as arm 226 is attached to the end of shaft 142. Thus, as shaft 142 rotates in a reciprocating manner during the operation of the upstacking device, arm 226 will be pivotally moved as indicated generally by arrow 232.

Figure 12:
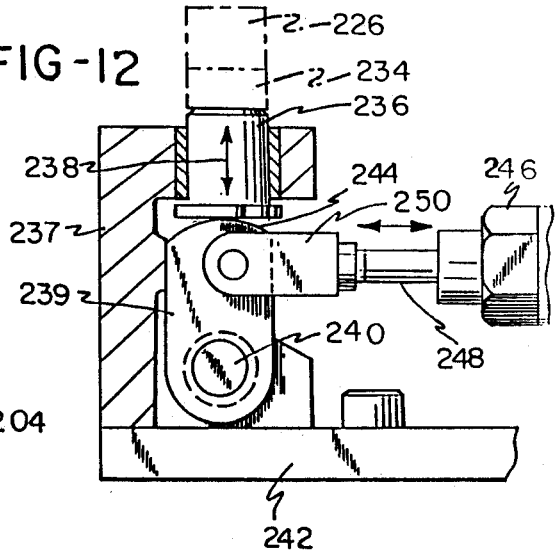
FIG. 12 is a side view of the stop mechanism, taken generally along line 12—12 of FIG. 11.

At the distal end of arm 226, a stop pad 234 is mounted in a downward direction. Immediately beneath stop pad 234 is positioned a stop support 236, which is slidably held within a support 237 for vertical movement as shown by arrow 238. A cam member 239 is pivotally mounted at 240 to base plate 242 and defines a cam surface 244 on which stop support 236 rests. The radius of curvature of surface 244 decreases away from vertical in a counter-clockwise direction as viewed in FIG. 12.

An air cylinder 246 includes an actuator 248 which is in turn coupled through clevis 250 to cam member 239. When actuated to fully retract actuator 248, cylinder 246 moves cam member 239 in a clockwise direction. The decreasing radius of surface 244 results in downward movement of stop support 236. Subsequent extension of actuator 248 returns cam member 239 to a vertical orientation, moving stop support 236 upwardly.

Such means for lowering stop support 236 is necessary because support 236 is normally positioned so that stop pad 234 on arm 226 will contact stop support 36 at the lowermost portion of the upstacker stroke. As a result, during upstacking operations, pad 234 will just contact support 236. Such contact is clearly undesirable, particularly at press operating speeds in the order of hundreds of strokes per minute. To avoid this, stop support 236 is slightly lowered as has been described during upstacking operations so that no contact takes place between stop pad 234 and stop support 236. Stop support 236 is moved to its raised position whenever upstacking operations are discontinued so as to perform its stop function at such time. However, even during upstacking operations, the stop support 236 is lowered by only a relatively small amount, and therefore will still perform a stop function in the event of an apparatus failure or misalignment.

Control for cylinder 246 may be performed in conjunction with control for cylinder 214 actuating clutch block 174. Stop support 236 must be raised whenever clutch block 174 is disengaged from arm 136, at which time the actuator for cylinder 214 is extended; also, stop support 236 must be lowered whenever clutch block 174 is engaged with arm 136, at which time the actuator for cylinder 214 is retracted. Accordingly, cylinders 214 and 246 are controlled such that their respective actuators are moved oppositely. Cylinder 246 extends its actuator whenever the actuator for cylinder 214 is retracted, and vice versa.

The stop mechanism 222 is also important in the event that a malfunction in the upstacker device control system occurs, resulting in clutch block 174 being halted in a position where block 174 is engaged neither with arm 136 or the press frame. In such a case, the upstacking mechanism could fall downwardly, in which case stop mechanism 222 is required to prevent the upstacking mechanism from striking belt 60 or Other press components.

Finally, it should be noted that the upstacking mechanism described herein as the preferred embodiment functions with the input drive arm 136 being pivotal about drive shaft 142. Stacking arm 150 is rotationally fixed to shaft 142. However, it is possible to construct an embodiment of the present invention in which input drive arm 136 is fixed to the shaft and clutch block 174 engages and disengages stacking arm 150 from rotational connection with shaft 142. The manner in which such an embodiment can be carried out will be readily apparent to those skilled in the art, and may be based essentially on reversing the connections and arrangement of arms 136 and 150 on shaft 142.

One disadvantage to such an embodiment, however, is that the upstacking mechanism cannot be locked to the press frame upon deactivation. This is because arm 150 is not rotationally connected to shaft 142, and hence disengagement from the clutch block permits free rotation of arm 150. Thus, stop mechanism 222 must also be relied upon to prevent arm 150 from striking the conveyor belt upon release. It also should be recognized that in such an embodiment, clutch block 174 cannot be constructed to engage with the shaft support block as in the preferred embodiment, since this would result in the press drive being directly coupled to the press frame.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A device for upstacking generally flat metal ends for cans from an end transport means including an intermittently advancing conveyor means, said upstacking device comprising:

drive means for providing driving power;

input means coupled to said drive means for producing reciprocating rotational motion;

a support frame;

a drive shaft mounted for rotation to said frame along a horizontal axis;

a stacking arm fixedly connected to said drive shaft and having a distal end, whereby reciprocating rotation of said shaft produces rising and falling motion of said distal end between raised and lowered positions;

stack piston means pivotally connected to said distal end of said stacking arm and having a can end engaging surface;

said drive shaft, said stacking arm and said piston means being mounted to said supporting frame such that (a) whenever said stacking arm is in said lowered position, said can end engaging surface is positioned below said conveyor means, and (b) said piston means is aligned with openings in said conveyor means for movement therethrough; and clutch means for selectively (1) engaging said input means with said drive shaft for reciprocating driving of said stacking arm and said piston means for stacking of said can ends, and alternately, (2) engaging said drive shaft with said frame for locking of said stacking arm and said piston means into said lowered positions.

2. The upstacking device of claim 1 wherein said input means is positioned on said drive shaft for rotational motion about said drive shaft along said horizontal axis.

3. The upstacking device of claim 2, wherein said stack piston means includes a stack piston rigidly connected to a piston support block, said piston support block being pivotally connected to said stacking arm, and piston guide means for confining said piston to reciprocating movement in a vertical direction.

4. The upstacking device of claim 2, wherein said input means includes a cam connected to said drive means for rotation, cam follower means coupled to said cam for following said cam in a reciprocating motion, and an input arm connected for pivotal motion to said cam follower means and to said drive shaft for reciprocating rotational motion thereon.

5. The upstacking device of claim 4 wherein said clutch means includes a clutch block slidably mounted to said drive shaft but rotationally fixed thereon, means for selectably sliding said clutch block along said drive shaft from a first position adjacent said input arm to a second position remote from said arm, and engagement means for engaging said clutch block with said input arm when in said first position whereby said input arm and said clutch block are rotationally locked.

6. The upstacking device of claim 5 wherein said clutch block and said input arm together define first and second surfaces positioned adjacent each other whenever said clutch block is in said first position, and said engagement means includes at least one ridge defined on said first surface and an equal number of corresponding recesses defined on said second surface.

7. The upstacking device of claim 5 wherein said support frame includes an engagement portion located adjacent said drive shaft such that said engagement portion is disposed adjacent said clutch block when in said second position, and wherein said clutch means includes second engagement means for engaging said clutch block with said engagement portion when in said second position whereby said support frame and said clutch block are rotationally locked.

8. The upstacking device of claim 7 wherein said clutch block and said input arm together define first and second surfaces positioned adjacent each other whenever said clutch block is in said first position, and said engagement means includes at least one ridge defined on said first surface and an equal number of corresponding recesses defined on said second surface.

9. The upstacking device of claim 8 wherein said clutch block and said engagement portion together define third and fourth surfaces positioned adjacent each other whenever said clutch block is in said second position, and said engagement means includes at least one ridge defined on said third surface and an equal number of corresponding recesses defined on said fourth surface.

10. The upstacking device of claim 5 wherein said means for sliding said clutch block includes gripping means for gripping said clutch block, and actuating means for causing lateral movement of said gripping means in a direction parallel to said shaft.

11. The upstacking device of claim 10 wherein said clutch block includes a circumferential recess defined around said block, said gripping means includes a yoke member having a pair of legs engaged with said recess and a rod pivotally connected to said support frame for pivotal movement in a plane parallel to said shaft, and said actuating means includes an actuator connected to said rod and linear drive means for extending and retracting said actuator.

12. A device for upstacking generally flat metal ends for cans from an intermittently advancing conveyor means, said upstacking device comprising:

drive means for providing driving power;

input means coupled to said drive means for producing reciprocating rotational motion;

a support frame;

a drive shaft mounted for rotation on said frame about a horizontal axis;

said input means being positioned on said drive shaft for rotational motion about said horizontal axis;

a stacking arm connected to said drive shaft and having a distal end, whereby reciprocating rotation of said stacking arm about said horizontal axis of said drive shaft produces rising and falling motion of said distal end between raised and lowered positions;

stack piston means pivotally connected to said distal end of said stacking arm and having a can end engaging surface;

said drive shaft, said stacking arm and said piston means being mounted to said supporting frame such that (a) whenever said stacking arm is in said lowered position, said can end engaging surface is positioned below said conveyor means, and (b) said piston means is aligned with openings in said conveyor means for movement therethrough; and clutch means positioned on said drive shaft for selectively (1) coupling said input means with said stacking arm for reciprocating driving of said stacking arm and said piston means for stacking of said can ends, and alternately, (2) decoupling said stacking arm from said input means for discontinuing driving of said stacking arm and said piston means.

13. The upstacking device of claim 12 wherein said stacking arm is fixedly connected to said drive shaft, said input means is positioned on said drive shaft for rotational motion thereabout, and said clutch means is constructed to selectively alternately engage said input means with said drive shaft and engage said drive shaft with said frame.

14. The upstacking device of claim 12 wherein said input means is fixedly connected to said drive shaft, said stacking arm is positioned on said drive shaft for rotational motion thereabout, and said clutch means is constructed to selectively alternately engage and disengage said stacking arm and said drive shaft.

* * * * *